United States Patent [19]

Irwin

[11] 4,125,922

[45] Nov. 21, 1978

[54] JET TANGLER

[75] Inventor: Malcolm P. Irwin, West Grove, Pa.

[73] Assignee: Techniservice Division, Textured Yarn Co. Inc., Kennett Square, Pa.

[21] Appl. No.: 835,583

[22] Filed: Sep. 22, 1977

[51] Int. Cl.[2] ..... D02G 1/16; D02G 1/12

[52] U.S. Cl. ..... 28/221; 28/258; 28/266; 28/274

[58] Field of Search ..... 57/34 B, 157 F; 28/220, 28/221, 263, 265, 266, 271, 273, 274, 276, 258

[56] References Cited

U.S. PATENT DOCUMENTS

| | | | |
|---|---|---|---|
| 3,426,406 | 2/1969 | McCutchan | 28/276 |
| 3,808,654 | 5/1974 | Stanley | 28/265 X |
| 3,822,543 | 7/1974 | Edagawa et al. | 57/34 B X |
| 3,914,929 | 10/1975 | Adachi et al. | 57/34 B |
| 3,978,558 | 9/1976 | Pike | 28/274 |
| 3,983,609 | 10/1976 | Pike | 28/274 |
| 4,041,586 | 8/1977 | Foster et al. | 28/265 X |
| 4,063,338 | 12/1977 | Wyatt | 28/221 |

*Primary Examiner*—Donald Watkins
*Attorney, Agent, or Firm*—Miller & Prestia

[57] ABSTRACT

A jet tangler is provided having a sharply angled passageway for the yarn and having a special air passageway arrangement which minimizes or substantially eliminates the aspiration effect encountered in jet tanglers of the prior art, especially at low tension. The tangler operates efficiently at low or high yarn tension, on texturized or as-produced yarn.

12 Claims, 4 Drawing Figures

JET TANGLER

BACKGROUND OF THE INVENTION

1. Field of the Invention

This invention relates to the jet tangling of moving textile strands and especially relates to an apparatus for the continuous jet tangling of filamentary yarn on the run.

2. Description of the Prior Art

In the processing of synthetic continuous filaments, various treatments have been devised to produce so-called texturized continuous filament yarns which are bulky and have wool-like properties. It is well known in the textile industry to obtain these effects by treatment of running yarns with fluid streams. The fluid processes permit effective treatment at high linear yarn speeds.

Breen U.S. Pat. No. 2,783,609, for example, discloses a technique for improving the bulk of continuous filament yarns rendering them light in weight and causing them to have a bulk and surface texture comparable to yarns spun from natural staple fibers. This technique involves exposing a filamentary material to a rapidly moving turbulent fluid, thereby inducing formation of a multitude of filament loops arranged at random intervals along the lengths of the individual filaments. Yarn produced by stuffer crimping has similar properties and qualities; the Breen jet produces loops in the yarn filaments in order to provide a bulked continuous filament yarn.

Such yarns, however, are sharply distinguishable from so-called compact yarns, which are also produced by running the yarn through a fluid jet. This involves fluid treatment of textile strands to make them more compact and to improve their structural integrity without twisting, as in U.S. Pat. No. 3,364,537 (Bunting and Nelson), 3,083,528 (Dalstrom & West), and 3,426,406 (McCutchen), for example. However, they rely upon relatively uncontrolled or random fluid turbulences, as in whipping the component filaments of a multifilament strand about the strand axis, for example.

Stanley U.S. Pat No. 3,279,025 discloses a stuffer crimper in which the exit from the yarn crimping chamber is substantially unrestricted, and which operates in self-balancing manner, wherein the yarn speed is kept substantially constant both in crimping and winding. Although we have endeavored to impart cohesiveness to the bulky yarn produced by such stuffer crimpers, by the use of jet tanglers, difficulties have been encountered due to the aspirating effect of the jet. In many cases, this effect tended to strip considerable quantities of yarn from the stuffer crimper chamber, thus upsetting its inherent balance and producing non-uniform yarn. To overcome this, it has been found necessary to increase the yarn take-up tension to minimize the aspiration effect, thus reducing the available degree of entanglement.

OBJECTS OF THE INVENTION

It is accordingly an object of this invention to overcome the foregoing difficulties and disadvantages, and to produce an entangled yarn having advantageous properties.

Another object of this invention is to provide a jet tangler which has a minimal aspirating effect, and which is "balanced" in such a manner that it operates effectively at high and low tensions, in the processing of a variety of yarns, including bulked continuous filament yarn.

Still another object of this invention is to provide a jet tangler which operates effectively and efficiently on texturized yarn, such as stuffer crimped yarn, and the like.

Still another object of this invention is to provide a jet tangler which operates efficiently throughout a wide range of tensions and accommodates a wide range of yarn deniers, and which produces a high quality texturized and cohesive yarn.

Other objects and advantages of this invention, including the simplicity and the economy of the same, and the ease with which it may be applied to existing yarn production processes, will further become apparent hereinafter and in the drawings, of which:

DRAWINGS

DETAILED DESCRIPTION OF THE INVENTION

In the detailed description which follows, specific terms will be used in the interest of clarity. They are not intended to define or to limit the invention, the scope of which is defined in the appended claims.

Figure 1:
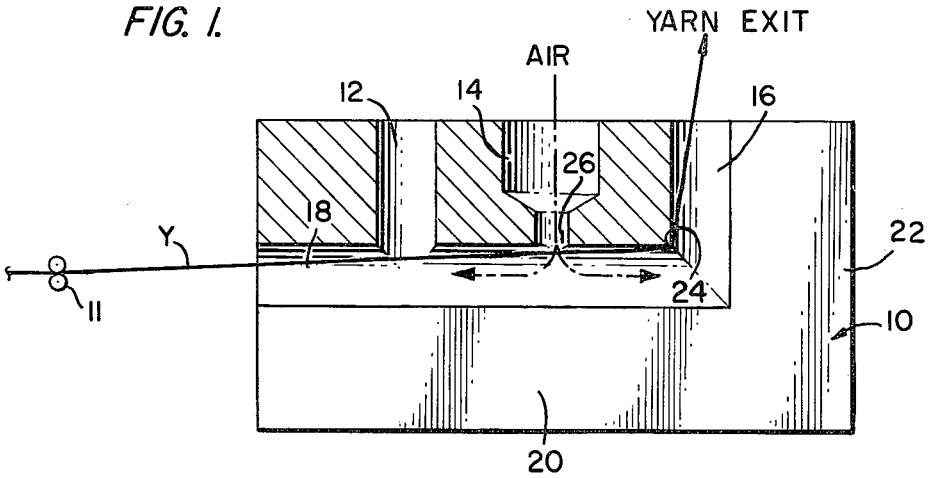
FIG. 1 is a vertical sectional view of a jet tangler embodying features of this invention.

Turning now to FIG. 1 of the drawings, the yarn Y has a path extending from a stationary feed guide 11 into a central bore 18, forming an air tangling chamber. As shown in FIG. 1, the central bore 18 extends longitudinally along the body 10 of the tangler, terminating in a sharp angularly related exit passages 16 for the yarn. As shown in FIG. 1, the angle of exit passage 16 to the inlet passage 18 as selected for illustration therein is about 90°.

Extending substantially parallel to the exit passage 16 in FIG. 1 is an air inlet passage 14, shown as being centrally located longitudinally along the tangler 10 and essentially perpendicular to the yarn passageway 18. Air is provided from a source (not shown) and is introduced under pressure through the inlet 14 in a manner to impinge the air upon the yarn Y as it moves within the yarn passageway 18.

Located upstream of the air inlet passage 14, and extending essentially perpendicularly to the yarn passage 18, is an upstream air vent 12 having a diameter greater than that of the air jet inlet 26 and, as shown, substantially equal to that of yarn passageway 18.

As shown, the lower body portion 20 and the right hand body portion 22 of the tangler 10 are slotted for ease of threading; this slot 23 extends all the way from the lower and right hand edges of the tangler to the central exit passageways 18, 16, on that part of body portion 22 which extends away from air inlet passageway 14. The width of the slot is much smaller than the sizes of the passageways 12, 14, 16 and 18, minimizing the amount of air capable of flowing outwardly through the slot. The exiting yarn is, of course, conveniently connected to a yarn winder (not shown) which applies tension to the yarn as it is continuously formed into a package.

As shown in FIG. 1, the air introduced into the jet divides and flows both upstream and downstream with respect to the flow of the yarn, some of the air flowing upstream from inlet 14 and upwardly and outwardly through the upstream air vent 12 and some flowing out the yarn entrance of the bore 18. Further, some of the air flows out the yarn exit passage 16. The upstream (countercurrent) air flow, having an upward component as well, also tends to maintain the yarn in an elevated position within the passageway 18, relatively close to the air aspiration point 26 as distinguished from the bottom of passageway 18.

The provision of countercurrent air flow with respect to the direction of yarn movement is an important and advantageous feature of the invention.

As shown, the air flowing downstream from the air inlet 14 flows, of course, downstream (co-currently) with the yarn and takes a sharp turn before it flows out the yarn exit 16.

Accordingly, it will be appreciated that in accordance with this invention the yarn is subjected to tangling by impingement of air at least a part of which flows in an upstream direction. The air flow in this manner has a remarkable effect upon the operating capabilities of the tangler, and substantially completely eliminates any tendency of the tangler to aspirate yarn from its source.

Figure 2:
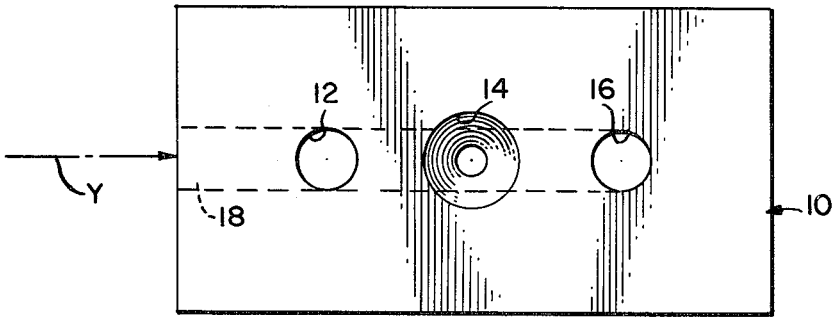
FIG. 2 is a plan view of the tangler of FIG. 1.

As is illustrated in FIG. 2 of the drawings, the passageways 12, 14 and 16 are shown aligned with each other. As shown, the passageway 16 extends in substantially the same direction as the air passageway 14. As shown in FIG. 1, the yarn exiting from the tangler is under tension because of the action of the yarn winder or other take-up device which is drawing it off, and the effect of this tension is to raise the yarn toward the edge 24 and to bring the yarn close to the air inlet point 26 at the innermost portion of the air inlet passageway 14. Other suitable arrangements and modifications may be utilized.

It has been found to be important to provide a sharply angled yarn path as shown in FIG. 1, wherein the exiting yarn extends at a sharp angle to the path of the yarn as it passes under the air inlet point 26. By this means, a highly effective, highly tangled yarn can be obtained. Further, the upwardly directed path of the yarn brings it close to the air injection point 26, which has a beneficial effect upon yarn tangling effectiveness and efficiency.

Figure 3:
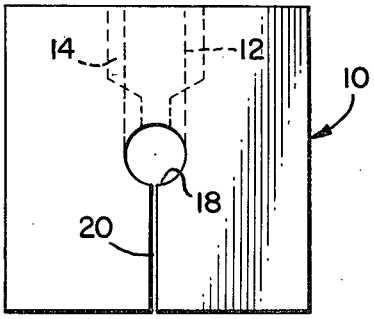
FIG. 3 is an end view of the tangler of FIGS. 1 and 2.

In FIG. 3 of the drawings the passageways 12, 14 and 16 are shown as being substantially aligned with each other. It will be appreciated that the upstream air vent 12 may be arranged in substantially any desired direction, although even this upstream air vent 12 is preferably extended in substantially the same direction as the air inlet 14.

Figure 4:
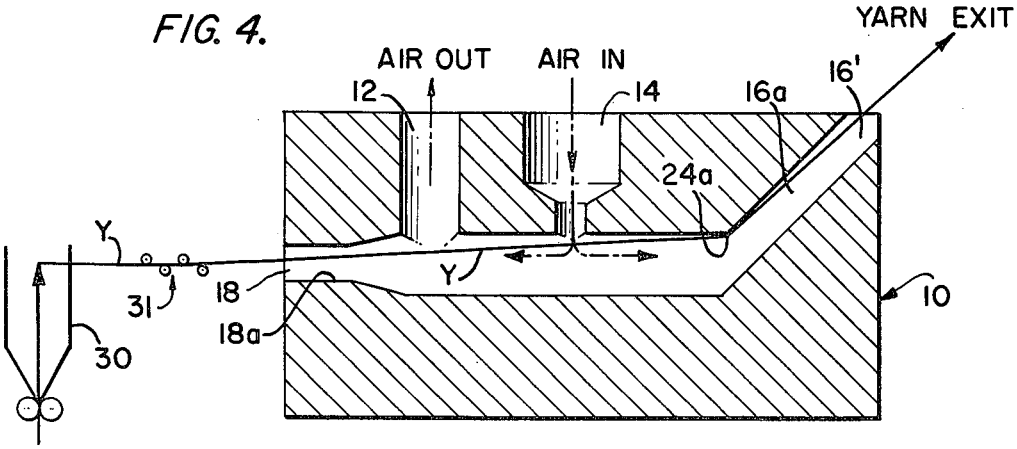
FIG. 4 is a vertical sectional view of a modified form of the tangler, shown in combination with a stuffer crimper and a yarn tension gate.

FIG.4 of the drawings shows an alternative embodiment of the invention, wherein the diameter of the passageway 18 is reduced at 18(*a*) at the inlet, and wherein the yarn exit 16' is angled at about 135° to the axis of the passageway 18. Further, the diameter of the passageway 16' is reduced as indicated at 16*a*. The reduced diameter 16*a* may be provided to reduce air loss, and to balance any possible aspiration effect which might otherwise tend to drive the yarn positively in a downstream direction through the tangler.

Also shown in FIG. 4 is a stuffer crimper 30 which may be of the type shown in the aforementioned Stanley et al U.S. Pat. No. 3,279,025, which is an open end crimper arranged to feed the yarn Y directly to a tension gate 31. There is a tendency for known tanglers, even when operating through a tension gate 31 which is preferably set at a reasonably light tension, to strip the yarn out of the chamber of the stuffer crimper 30, by reason of the aforesaid aspiration effect. No such tendency is exhibited by the tangler of this invention.

In the crimper of FIG. 4, the yarn paths extends essentially from the tension gates 31 to the corner 24*a*, and then out the yarn exit 16'.

The tangler of FIG. 1 and all other forms of tanglers in accordance with this invention, may be utilized in combination with the stuffer crimper and tension device of FIG. 4.

Although I am unable to provide scientific basis for the phenomena underlying the surprising performance of the tangler in accordance with this invention, it has been clearly established that it is necessary to provide a combination of a sharply angled yarn withdrawal passage with an air flow component in the upstream direction with respect to the yarn. Utilizing such a combination, the tangler has the outstanding capability of handling bulky continuous filament yarn or textured yarn, yarns of high denier or low denier, and yarns of various other characteristics, and is capable of doing so under a wide variety of tension conditions, including very low tension.

Although the drawings show yarn exits 16, 16' which are arranged at specific angles to the axis of the main tangling passage 18, it is possible to vary the angle of the yarn exit through a considerable range. However, an angle in the range of 45° to 135° is preferred, with 70° to 110° particularly preferred. Although not specifically shown in the drawings, angles less than 90°, such as 45° to 90°, may also be utilized, with 70° to 110° preferred, and with 90° as in FIG. 1 most particularly preferred.

Although it was initially believed that in some cases it might be possible to eliminate the yarn exit passageway 16, 16' entirely by simply terminating the jet tangler body at that point, and by substituting an external guide for the yarn to constrain it to a path extending at an angle of about 45° to 135° to the axis of the yarn path in the yarn tangling passageway 18, this has been found ineffective. When that portion of the air which travels in a downstream direction simply exhausts in the downstream direction and out the air outlet 12, as previously described, the effects of this invention are not realized. Accordingly, the provision of an angled exit passageway is a critical feature of this invention.

It is believed that the efficiency and effectiveness of the tangler is greatly improved by the provision of the upstream air vent 12, which relieves a considerable portion of the air that would otherwise flow countercurrently out through the yarn entrance to the passageway 18. The reason for this surprising effect is not fully understood, but test runs have indicated that inferior effects are obtained when the air vent 12 is plugged or blocked, all other conditions remaining the same.

Many jets operating according to principles of the prior art fail to operate effectively at high tension, and if efforts are made to use them at low tension in a crimping system involving a non-positive feed, they tend to aspirate, which strips out the crimping chamber and produces a non-uniformly crimped yarn product. The jet in accordance with this invention operates effectively and efficiently at high tension, which is an advantage in itself. It is not always possible to operate at low tension even though this may be desired. For example, high tension may be needed to split out two ends of yarn which have been passed through the crimping chamber for concurrent crimping. The jet in accordance with this invention also works effectively at low tension, without aspirating. Accordingly, the jet in accordance with this invention has the advantage that it can be used at low tensions whenever high tension is not needed for some other reason. With other jets with which we are familiar, it has been necessary to use a sufficiently high tension to avoid aspirating, even though this somewhat decreases the attainable degree of entanglement. Further, the jet in accordance with this invention allows the yarn to enter and leave at a non-sensitive straight angle, without being caught in a twist-causing air stream.

It is important in accordance with this invention that management of the air exits provided in the jet tangler allows the yarn to enter and leave the jet at non-sensitive relatively straight angles, without being caught in the air stream and becoming excessively twisted. Because of the provision for upstream air exit not only at the yarn inlet passageway but also at the upstream air vent, combined with the provision of a divided air passage allowing air exit downstream along with the yarn, we have avoided problems heretofore encountered, in which the jet was very sensitive with respect to the yarn path angles provided for entering and leaving the jet. In some cases, it has heretofore been found necessary to provide very sharp yarn angles in order to obtain efficient and effective jet operation.

A great many variations may, of course, be applied to this invention. The sizes, shapes and configurations of the various passageways may be modified, as may their positions longitudinally with respect to the tangler body. However, it is critically important to so guide the yarn path that it forms a sharp angle such as that illustrated at the corner 24, or 24(*a*) in the drawings, extending at an angle of about 45° to 135° to the axis of the yarn in the tangling chamber.

Although various tensions may be utilized, it has been found that excellent results have been obtained with the utilization of tensions in the range of about 100 to 200 grams when utilizing relatively heavy denier yarns such as 1300 or 2600 denier. A considerable number of tests have been run on 1300 denier, 55 filament yarn and on 2600 denier, 100 filament yarn as well. The invention is applicable to yarns of much smaller and much larger deniers, as well.

This invention has a special advantage when applied to yarn having a non-positive feed. This is because the tangler can be so constructed and so adjusted as to provide substantially zero aspirating effect, thus allowing it to run at exceedingly low tensions, if desired. In this connection, this invention has particular advantage for the jet tangling of yarn which has been previously texturized (bulked continuous filament yarn).

Although specific forms of tanglers have been shown in the drawings for providing counter-current air flow combined with co-current air flow, it will be appreciated that the sizes and arrangements of the air openings may be varied in order to provide more or less counter-current air flow. In many cases, it appears that increased counter-current flow improves the jet operation. Indeed, it is conceivable to provide substantially all of the air flow passing outwardly through the upstream air vent, with the other passageways substantially completely blocked off. Further, it is possible in some cases to exhaust most of the air and the associated lubricating materials or finish, and also to muffle the noise satisfactorily, by running an exhaust line out of the upstream air vent, instead of boxing in the entire jet.

Other variations may be made, such as by providing fluids other than air, or by providing venturis in selected passageways, including passageways 12, 14, and 16, for example. Similarly, a venturi could be provided in passageway 18 at the entrance or elsewhere.

Although this invention has been described with reference to specific embodiments thereof, and to specific variations heretofore discussed, it will be appreciated that a wide variety of other changes may be made without departing from the the spirit and scope of the invention. Similarly, parts may be reversed and certain features used independently of other features, all in accordance with the spirit and scope of this invention, as defined in the appended claims.

I claim:

1. A jet tangler for multifilament yarn comprising:

a. a body having a passageway through which the yarn is extended in a predetermined path for movement in a downstream direction, b. said body having a fluid inlet for projecting fluid under pressure against said yarn while said yarn is travelling in said yarn passageway, said fluid inlet having an air injection point at the intersection of said passageways (a) and (b), c. said body having a fluid release passageway located upstream of said fluid inlet passageway for releasing at least a portion of said fluid, said fluid release passageway being further located in relation to said fluid inlet so that said release portion of said fluid directs said yarn in close proximity to said air injection point.

b. said body including a sharply angled yarn exit passageway connected to said passageway (a) at a location downstream of said fluid inlet for sharply changing the path of said yarn in said body, said exit passageway being further located so that said angled path of said yarn brings said yarn close to said air injection point.

2. The tangler defined in claim 1, wherein said exit passageway is arranged at an angle of about 45° to 135° to said passageway (a).

3. The tangler defined in claim 2, wherein said angle is about 70° to 110°.

4. The tangler defined in claim 3, wherein said angle is about 90°.

5. The tangler defined in claim 1, wherein passageways (b) and (d) lie in substantially the same plane and both extend in substantially a common direction from passageway (a).

6. The tangler defined in claim 5, wherein passageway (c) also lies in substantially the same plane with passageways (b) and (d) and extends in substantially the same direction from passageway (a).

7. The tangler defined in claim 1, wherein a portion of said body extending from said passageways (a) and (d) in a direction extending away from passageway (b), is slotted for yarn threading.

8. The tangler defined in claim 1, wherein the cross section of fluid release passageway (c) is greater than that of fluid inlet passageway (b) at the point of fluid introduction into passageway (a).

9. The tangler defined in claim 1, wherein flow restricting means is provided in one of said passageways.

10. The tangler as defined in claim 1, wherein venturi means is provided in one of said passageways.

11. In combination, a. a stuffer crimper having a crimping region and an entrance and an exit for yarn, together with means for forcing said yarn into said region to accumulate temporarily and to crimp therein, the yarn accumulation being unconfined at the exit from said region, b. a yarn tension device located downstream of said stuffer crimper to receive yarn from said unconfined exit, and c. a jet tangler downstream of said yarn tension device (b), and connected to receive the yarn therefrom, said jet tangler being the tangler of claim 1.

12. A jet tangler for multifilament yarn comprising:

a. a body having a passageway through which the yarn is extended in a predetermined path, b. said body including a yarn passageway sharply angled with respect to said passageway (a) and in communication therewith so that said yarn traverses said body by extending through said passageways (a) and (b), c. said body having a fluid inlet for projecting fluid under pressure against said yarn while said yarn is travelling in said yarn passageway (a), said fluid inlet having an air injection point at the intersection of said passageways (a) and (b), d. said body having a fluid release passageway for releasing at least a portion of said fluid, said fluid release passageway spaced from said passageway (b) and said fluid inlet so that said fluid inlet is between said fluid release passageway and said passageway (b), said fluid release passageway location with respect to said fluid inlet provides said release portion of said fluid with a directional component which directs said yarn in close proximity to said air injection point, e. said passageway (b) being further located so that said angled path of yarn brings said yarn close to said air injection point.

* * * * *